US006613503B1

(12) United States Patent
Isaac et al.

(10) Patent No.: US 6,613,503 B1
(45) **Date of Patent: *Sep. 2, 2003**

(54) USE OF LARGE PARTICLE SIZE LUBRICANTS IN THE PROTECTIVE OVERCOAT OF PHOTOGRAPHIC PAPERS

(75) Inventors: Walter Harold Isaac, Penfield, NY (US); James Stephen Honan, Spencerport, NY (US); Edgar Erick Riecke, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/670,466

(22) Filed: Jun. 26, 1996

(51) Int. Cl.[7] ..... G03C 1/76

(52) U.S. Cl. ..... 430/523; 430/631; 430/632; 430/633; 430/634; 430/635; 430/636; 430/637; 430/638; 430/961; 430/931; 430/950; 430/512

(58) Field of Search ..... 430/523, 631, 430/632, 633, 634, 635, 636, 637, 638, 961, 931, 950, 512

(56) References Cited

U.S. PATENT DOCUMENTS

| | | | | |
|---|---|---|---|---|
| 4,004,927 | A | 1/1977 | Yamamoto et al. | 430/523 |
| 4,499,179 | A | 2/1985 | Ota et al. | 430/523 |
| 5,019,491 | A | 5/1991 | Takeuchi | 430/523 |
| 5,208,139 | A | 5/1993 | Ishigaki | 430/523 |
| 5,219,992 | A | 6/1993 | Specht et al. | 530/354 |
| 5,468,604 | A | 11/1995 | Zengerle et al. | 430/631 |
| 5,529,891 | A | 6/1996 | Wang et al. | 430/523 |
| 5,541,048 | A | 7/1996 | Whitesides et al. | 430/523 |

OTHER PUBLICATIONS

Walstra, "The Foundation of Emulsions", Chap. 2, Encyclopedia of Emulsion Technology, vol. 1, 1983.

*Primary Examiner*—Geraldine Letscher
(74) *Attorney, Agent, or Firm*—Paul A. Leipold; Lynne M. Blank

(57) ABSTRACT

The invention relates to a photographic element comprising a reflection support and an overcoat layer wherein said overcoat layer comprises hydrophilic binder and lubricant, said lubricant has a particle mean diameter of greater than 1 $\mu$m and the volume of particles of lubricant below 1 $\mu$m is less than 5% of said total volume of lubricant.

11 Claims, No Drawings

USE OF LARGE PARTICLE SIZE LUBRICANTS IN THE PROTECTIVE OVERCOAT OF PHOTOGRAPHIC PAPERS

FIELD OF THE INVENTION

This invention relates to the formulation of color photographic papers. It particularly relates to the formulation of photographic papers having less upper scale haze, improved resistance to dry scratching, and excellent slip characteristics before and after photographic processing.

BACKGROUND OF THE INVENTION

A property of photographic papers that is of interest is to have a slip agent in the layer furthest from the support to improve the papers resistance to scratching and emulsion pressure sensitivity. Furthermore it is desirable to have overcoat lubricants that provide good slip properties and resistance to dry scratching in the processed photograph. Papers without adequate lubricity can cause sticking problems during conveyance through photoprocessing equipment, especially in minilabs where smooth metallic and glass surfaces contact the emulsion surface. Emulsion to backside lubricity is desired for post processing print stacking operations that occur on many minilabs. The overcoat lubricant is most effective when it is present in the top layer on the emulsion side.

These lubricants typically are agents that are insoluble in aqueous media. They may be dissolved in high boiling organic solvents, and this mixture is mixed under high shear or turbulence together with an aqueous medium to form a dispersion. The overcoat lubricant dispersions can cause a light scatter problem when they are present at the surface of the coating. The amount of light scatter is dependent on the match of the complex refractive indexes between the overcoat lubricant dispersion and the surrounding hydrophilic colloid media, as well as the particle size of the dispersion. Typically this light scatter problem is most prevalent at very high print densities, where very little light is reflected back to the viewer. Any diffuse angle first surface reflection present in the coating limits the density that can be measured, or seen by the eye at a diffuse angle relative to the angle of illumination. This first surface reflection phenomenon is typically referred to as "haze". Reducing the particle size of the overcoat lubricant dispersion on the surface of the coating can result in a haze improvement and it effectively increases the reflection limit of the print, but it also causes a loss in lubricity, requiring more lubricant to achieve the desired slip characteristics. The maximum print densities decrease as the lubricant levels are increased.

U.S. Pat. No. 5,208,139 describes a multilayer structure that contains colloidal silica with at least non-silver bearing layer and a non-silver bearing overcoat with lubricant. U.S. Pat. No. 5,019,491 describes a photo material with at least 1 light sensitive layer and at least 1 layer containing lubricant. U.S. Pat. No. 4,004,927 describes a photographic material containing a liquid organopolysiloxane. U.S. Pat. No. 4,499,179 describes oil particles in the top layer of a photographic element.

PROBLEM TO BE SOLVED BY THE INVENTION

There is a continuing need for improved overcoat lubrication to provide resistance to scratching and improved slip properties in processed photographic paper. There is particularly a need for lubricants that will provide lubricity to photographic elements without causing an increase in light scatter that results in a hazy appearance, especially in dark areas of a photographic print.

SUMMARY OF INVENTION

An object of the invention is to overcome disadvantages of prior photographic papers.

It is another object of the invention to provide photographic papers having improved resistance to scratching and good slip properties.

A further object is to provide photographic papers with good lubricity and low haze in dark areas of the print.

These and other objects of the invention are generally accomplished by a photographic element comprising a reflection support and an overcoat layer wherein said overcoat layer comprises hydrophilic binder and lubricant, said lubricant has a particle mean volume diameter of greater than 1 $\mu$m and the total volume of particles of lubricant below 1 $\mu$m is less than 5% of said total volume of lubricant.

ADVANTAGEOUS EFFECT OF THE INVENTION

The invention has numerous advantages over prior techniques for providing lubricity to photographic elements. The photographic elements of the invention have low haze. Further the elements have good slip properties and resistance to dry scratching of the processed photograph. The invention also allows the use of less lubricant to achieve a given lubricity, thereby lowering cost and improving photographic properties.

DETAILED DESCRIPTION OF THE INVENTION

With our invention we can achieve good slip properties at low lubricant coverages with very high maximum print densities (low haze) by using large particle sized dispersions of common overcoat lubricants. The examples that we have produced have very low friction coefficients with haze levels that matched model format coatings with no overcoat lubricant. We found that the advantages of large particle sized dispersions can be obtained by using a pre-mix of dispersion, where the particle size distribution is very broad, but the vast majority of the volume percent of the lubricant is present as droplets that are greater than 1 micron in diameter. A preferred embodiment of this invention is the use of emulsifying techniques that produce uniformly large droplets that are 1 to 12 $\mu$m in average particle diameter. Limited coalescence is one emulsifying technique that can be employed to make narrow particle size distribution within this 1–12 micron size range.

In performing the invention, any suitable lubricant may be utilized. There is no limitation on the types of lubricants for the practice of the present invention. Typical lubricants include (1) silicone based materials disclosed, for example, in U.S. Pat. Nos. 3,489,567; 3,080,317; 3,042,522; 4,004,927; 4,047,958; and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,522; and 4,427,764, in British Patent Nos. 1,263,722; 1,198,387; 1,430,997; 1,466,304; 1,320,757; 1,320,565; and 1,320,756; and in German Patent Nos. 1,284,295; and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly (tetrafluoroethylene), poly(trifluorochloroethylene), poly (vinylidene fluoride, poly(trifluorochloroethylene-co-vinyl chloride), poly(meth)acrylates or poly(meth)acrylamides containing perfluoroalkyl side groups, and the like. Lubricants useful in the present invention are also described in further detail in *Research Disclosure*, No. 308, December 1989, page 1006, all of the above incorporated herein by reference.

The above lubricants also may contain reactive functional groups such as hydroxyl, thiol, carboxyl, carbodiimide, epoxy, aziridine, vinyl sulfone, sulfinic acid, active methylene, amino, and amide. Typical examples of compounds useful for the present invention are shown below, but the present invention is not limited by these compounds:

L-1. Carnauba Wax, Michelube 160 [Michelman Inc.]
L-2. Paraffin Wax 112/118 AMP, m.p.=46.1° C. [Frank B. Ross Inc.]
L-3. Paraffin Wax 125/130 AMP, m.p.=53.3° C. [Frank B. Ross Inc.]
L-4. Paraffin Wax 140/145 AMP, m.p.=61.1° C. [Frank B. Ross Inc.]
L-5. Ross Wax 140, m.p.=137.8° C. [Frank B. Ross Inc.]
L-6. Teflon 120, fluorinated ethylene propylene particles [E. I. du Pont de Nemours & Co.]
L-7. Teflon 30, poly(tetrafluoroethylene) particles [E. I. du Pont de Nemours & Co.]
L-8. Teflon 335, poly(tetrafluoroethylene-perfluoro(propyl vinyl ether)) particles [E. I. du Pont de Nemours & Co.]
L-9. GP-218 silicone polyol copolymer [Genesee Polymers Co.]
L-10. GP-4 silicone fluid, amine functionalized [Genesee Polymers Co.]
L-11. GP-7100 amine functional paintable silicone fluid [Genesee Polymers Co.]
L-12. GP-7200 silicone fluid, mercapto functionalized [Genesee Polymers Co.]
L-13. EXP-58 silicone wax [Genesee Polymers Co.]
L-14. EXP-61 silicone wax, amine functionalized [Genesee Polymers Co.]
L-15. EXP-77 silicone wax, mercapto functionalized [Genesee Polymers Co.]
L-16. GP-7101 silicone copolymer [Genesee Polymers Co.]
L-17. BYK-331, polyether modified di-methylpolysiloxane copolymer [BYK Chemie]
L-18. BYK-371, reactive silicone additive, an acrylic functional, polyester-modified dimethylpolysiloxane [BYK Chemie]
L-19. DC-200 silicone fluid [Dow Corning Inc.]
L-20. PS099 dimethylsiloxane-bisphenol A carbonate block copolymer [Petrarch Inc.]
L-21. PS130 polymethyloctadecylsiloxane [Petrarch Inc.]
L-22. PS135 poly(methylhexadecyl siloxane) [Petrarch Inc.]
L-23. PS-464 polydimethylsiloxane, vinylphenylmethyl terminated [Petrarch Inc.]
L-24. Sorbitan monostearate
L-25. Ethylene glycol distearate
L-26. Ethylene glycol monostearate
L-27. Potassium hexadecyl phosphate
L-28. Sodium hexdecanesulfonate
L-29. Lubracal 60, Calcium stearate
L-30. Sodium stearate
L-31. Lithium stearate
L-32. Glyceryl monostearate A preferred lubricant has been found to be polydimethylsiloxane, as it is low in cost and effective.

The overcoat layer containing the lubricant of the invention also may contain other materials. Such other materials include polymeric gelatin extenders, fillers such as latexes and colloidal silica. The overcoat layer may also contain matte beads that provide ferrotyping and blocking protection. The overcoat layer may also contain UV light absorbing materials as described in U.S. Pat. Nos. 4,528,311; 4,611,061; 4,785,063; and 4,892,915.

The gelatin utilized in the overcoat layers of the invention may be any suitable gelatin. Typical of such gelatins are alkaline processed bone gelatin, acid processed pigskin gelatin, derivatized gelatin as outlined in U.S. Pat. Nos. 5,219,992 and 5,316,902. Preferred gelatins are acid processed ossein gelatins.

The lubricant particles may be any suitable size of greater than 1 $\mu$m. Preferred are particles between about greater than 1 and 12 $\mu$m as they provide good lubricity with minimal light scatter. A more preferred particle size is between about 1.5 and 7.5 $\mu$m for good lubricity and the minimum light scatter. While the particle sizes referred to above are the mean diameter of the particles, it is also a feature of the invention that the lubricant particles of less than 1 $\mu$m in diameter comprise less than 5% of the total volume of lubricant in the overcoat layers.

The lubricants of the invention are generally formed by any means that result in particles of the desired size distribution. A suitable method of formation is a limited coalescence technique as shown in U.S. Ser. No. 08/440,265 filed May 5, 1995. Other techniques of forming particles are described in *Research Disclosure* No. 37038, February 1995. Other effective techniques for making particles are described in P. Walstra "The Encyclopedia of Emulsion Technology", Vol. 1, Chapter 2, pages 60–67 (1983).

The invention overcoat layer may be utilized in any photographic element. Typical of such elements are motion picture film, x-ray film, and color negative film. Preferred use of the invention is in color photographic paper as there is a particular need for improvement in lubricity without causing haze in the dark areas of a photographic print. The photographic paper materials may be formed by any of the conventional techniques available for forming such materials and may use any of the known materials for formation of color photographic papers. Typical of such materials are those disclosed in *Research Disclosure* No. 37038, February 1995.

The following examples illustrate the practice of this invention. They are not intended to be exhaustive of all possible variations of the invention. Parts and percentages are by weight unless otherwise indicated.

EXAMPLES

Overcoat lubricant dispersions were prepared in the following manner:

Preparation of Dispersion AA 89.1 g of Type IV gelatin and 21.3 g of a 10% solution of Alkanol XC (Dupont) were dissolved in 649.6 g of distilled water at 60° C. 60.0 g of dioctyl hydroquinone was dissolved in 180.0 g of dibutyl phthalate at 100° C., then added to the aqueous gelatin solution. The resulting mixture was premixed for 2 minutes using a rotor-stator high shear mixer at 8000 RPM, and passed through a Crepaco homogenizer one time at 5000 psi. This dispersion is referred to as dispersion AA (prior art).

Preparation of Dispersion AB 81.7 g of Type IV gelatin and 191.2 g of a 10% solution of Alkanol XC (Dupont) were dissolved in 579.9 g of distilled water at 80° C. 133.8 g of polydimethyl-siloxane (DC200-350 cS Dow Corning) and 13.4 g of a 10% solution of Tergitol 15-S-5 were blended and heated to 141° C. and this mixture added to the gelatin solution, then passed through a Gaulin homogenizer at 5000 psi. This dispersion is referred to as dispersion AB (prior art).

Preparation of Dispersion AC 90.1 g of Type IV gelatin and 178.0 g of a 10% solution of Dupanol ME (SDS) (Dupont) were dissolved in 630.9 g of distilled water at 49° C. 91.5 g of polydimethylsiloxane (DC200-350 cS Dow Corning) and 9.1 g of a 10% solution of Tergitol 15-S-5 were blended and heated to 49° C. and this mixture added to the gelatin solution with mixing. This mixture was then passed 3 times through a wire mesh button at 2000 psi. This dispersion is referred to as dispersion AC (prior art).

Preparation of Dispersion AD 60.0 g of Type IV gelatin and 190.0 g of a 10% solution of Dupanol ME (SDS) (Dupont) were dissolved in 602.0 g of distilled water at 80° C. 147.0 g of polydimethylsiloxane (DC200-350 cS Dow Corning) was added to this gelatin solution at 80° C. This mixture was blended using a Silverson rotor-stator pre-mixer until the solution appeared homogeneous. The volume average particle size of the dispersion as measured with a Coulter Multisize II was 11 $\mu$m and less than 1 percent of the volume of particles was less than 1 $\mu$m. This dispersion is referred to as dispersion AD (Invention).

Preparation of Invention Dispersions AE, AF, AG, and AH

An oil phase was prepared by combining 65.0 g of butoxyethoxyethyl acetate with 585.0 g of polydimethylsiloxane (DC200-350 cS Dow Corning). A stock suspension of colloidal silica in pH4 buffer was prepared by mixing 52.2 g of Ludox ™ (51.7% solids) with buffer (VWR Scientific pthalate buffer) to a total weight of 215.0 g and then readjusting the pH to 4 by the dropwise addition of 12 M hydrochloric acid. The promoter solution was a 6.0% solution of triethylphenylammonium chloride in water. Several dispersions of differing particle sizes were prepared from these stock solutions by combining them according to Table 1. A premix was prepared from each composition by stirring for 60 seconds with a high shear Silverson mixer. Dispersions AF, AG, and AH were then homogenized using a Microfluidics Corporation Microfluidizer operating at 8000 psi. Dispersion AE was homogenized at 5000 psi using a Crepco homogenizer.

TABLE 1

Composition of Limited Coalescence Direct Dispersions.

| Dispersion Code | Oil Phase (g) | pH 4 VWR Buffer (g) | Ludox Stock (g) | Promoter (g) |
|---|---|---|---|---|
| Dispersion AE | 210 | 379.4 | 103.5 | 7.1 |
| Dispersion AF | 210 | 379.4 | 103.5 | 7.1 |
| Dispersion AG | 210 | 426.4 | 59.6 | 4.1 |
| Dispersion AH | 210 | 450.9 | 36.8 | 2.5 |

After homogenization, 500.0 g of each dispersion was treated with 80.0 g of an aqueous solution containing 10% Alkanol XC (polyisopropyl napthalene sulfonate, an anionic surfactant made by Dupont) and 420.0 g of additional water. 1 Kg of a 15% solution of deionized Type IV gel was added to each dispersion with vigorous stirring using a marine propellor at 450 rpms. The final dispersions had final composition corresponding to 6.74% DC200, 7.5% gelatin, and 0.4% Alkanol XC. Analysis using a Coulter Multisizer II measured the volume weighted mean diameter ($D_v$) for each, as shown in Table 2.

TABLE 2

| Example | $D_v$ | Percent Less than 1 $\mu$m |
|---|---|---|
| AF | 3.2 | Less than 1% |
| AG | 5.5 | Less than 1% |
| AH | 8.8 | Less than 1% |
| AE | 3.0 | Less than 1% |

Samples S-1 to S-14 have an overcoat composition as defined in Table 3. Each was coated as a gelatin water dispersion with the other layers B-1 to UV-2 as also illustrated in Table 3. Coating was onto a glossy resin coated paper base. The coating was simultaneous from a bead coater.

| S-1 through S-14 (see Table 4) |
|---|
| UV-2 |
| R-2 |
| UV-2 |
| G-1 |
| IL-6 |
| B-1 |
| Pigmented Polyethylene Paper |
| Clear polyethylene |
| Backside antistat |

Discussion of Examples

Papers prepared as outlined in Table 3 were measured for coefficient of friction before and after photo-processing using the test method described in the Test Method below. The friction results from Examples S-5, S-8, S-11, S-12, S-13, and S-14 (invention) show very low friction coefficients at lubricant coverages that are lower than prior art Examples S-1, S-2, S-4, S-7, and S-10 as shown in Table 4.

All the paper examples in Table 3 were exposed with a white light exposure so that they reached maximum density when processed in Kodak RA-4 processing chemistry in the conventional manner. Each coating was measured using diffuse angle Status A densitometry, resulting in higher maximum white light densities as outlined in Table 4. The use of large particle pre-mix and limited coalescence dispersions from dispersions AD, AE, AF, AG, and AH have red, green, and blue Dmax densities equal to the examples that contain no overcoat lubricant (Examples S-3 and S-6). These dmax densities are significantly higher than Examples S-1, S-2, S-4, and S-10 containing overcoat lubricants with average particle sizes less than 1 micron in average particle diameter.

Test Method

The frictional properties of the papers were measured in an automated friction measuring device. The papers were mounted in a horizontally driven platform to convey a 35 mm×12-inch sample under a stationary friction sled attached to an electronic load cell with a non-elastic wire. The sled contacts the sample with three equally loaded 0.093-inch diameter, grade 25, tungsten carbide balls. Total weight of the sled is 305 grams. The sample is clamped to a flat glass base which moves at 72" per minute for 6 seconds. Start-up forces for the first second are ignored, and the average for the remaining 5 seconds is then recorded.

TABLE 3

Paper Formulation Examples

| Layer | Description of Formulation |
|---|---|
| S-3 | 1.076 g/m$^2$ of gelatin |
| S-1 | 1.076 g/m$^2$ of gelatin<br>0.022 g/m$^2$ of dioctyl hydroquinone from dispersion AA<br>0.066 g/m$^2$ of dibutyl phthalate from dispersion AA |
| S-2 | 1.076 g/m$^2$ of APO gelatin<br>0.027 g/m$^2$ of polydimethylsiloxane from dispersion AB |
| S-4 | 1.076 g/m$^2$ of gelatin<br>0.027 g/m$^2$ of polydimethylsiloxane from dispersion AC |
| S-5 | 1.07 g/m$^2$ of gelatin<br>0.016 g/m$^2$ of polydimethylsiloxane from dispersion AD |
| S-6 | 1.35 g/m$^2$ of APO gelatin |
| S-9 | 0.942 g/m$^2$ of APO gelatin<br>0.404 g/m$^2$ of $SiO_2$ from Ludox AM (Dupont) |
| S-7 | 1.35 g/m$^2$ of APO gelatin<br>0.032 g/m$^2$ of polydimethylsiloxane from dispersion AB |
| S-10 | 0.942 g/m$^2$ of APO gelatin<br>0.404 g/m$^2$ of $SiO_2$ from Ludox AM (Dupont)<br>0.034 g/m$^2$ of polydimethylsiloxane from dispersion AB |
| S-8 | 1.35 g/m$^2$ of APO gelatin<br>0.011 g/m$^2$ of polydimethylsiloxane from dispersion AE |
| IL-6 | 0.75 g/m$^2$ of gelatin<br>0.07 g/m$^2$ of dioctyl hydroquinone from dispersion AB |
| B-1 | 1.53 g/m$^2$ of gelatin<br>0.28 g/m$^2$ of silver as a cubic 0.79u mean edge length AgCl emulsion with <1 mole % Br<br>1.08 g/m$^2$ of the compound of formula 14-5<br>0.26 g/m$^2$ of dibutyl phthalate<br>0.26 g/m$^2$ of butyl carbitol acetate |

APPENDIX

FORMULA 14-1:

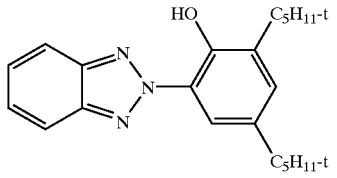

FORMULA 14-2:

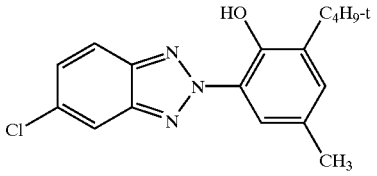

FORMULA 14-3:

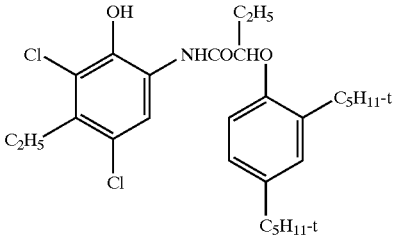

TABLE 4

Showing Benefits of Large Particle Sized Lubricant Dispersions:

| Example | Protective Overcoat | Overcoat Lubricant Dispersion Particle Size ($\mu$m) | White Light Exposure Status A Red Density | White Light Exposure Status A Green Density | White Light Exposure Status A Blue Density | IMASS Sled Friction (pre-process) | IMASS Sled Friction (post-process) |
|---|---|---|---|---|---|---|---|
| S-3 | Comparison | * | 2.88 | 2.83 | 2.60 | .783 | .815 |
| S-1 | Comparison | Approx 0.90 | 2.62 | 2.65 | 2.45 | .435 | .560 |
| S-2 | Comparison | 0.072 | 2.56 | 2.61 | 2.45 | .526 | .524 |
| S-4 | Comparison | 0.27 | 2.61 | 2.67 | 2.46 | .318 | .369 |
| S-5 | Invention | 11 | 2.85 | 2.81 | 2.58 | .269 | .406 |
| S-6 | Comparison | * | 2.84 | 2.80 | 2.74 | .977 | .643 |
| S-9 | Comparison | * | 2.86 | 2.83 | 2.63 | .710 | .718 |
| S-7 | Comparison | 0.072 | 2.67 | 2.62 | 2.46 | .519 | .487 |
| S-10 | Comparison | 0.072 | 2.63 | 2.59 | 2.48 | .427 | .403 |
| S-8 | Invention | 3.5 | 2.74 | 2.80 | 2.72 | .440 | .446 |
| S-12 | Invention | 3.2 | 3.01 | 2.91 | 2.65 | .321 | .294 |
| S-13 | Invention | 5.5 | 2.93 | 2.87 | 2.62 | .347 | .317 |
| S-14 | Invention | 8.8 | 2.94 | 2.85 | 2.63 | .305 | .204 |
| S-11 | Invention | 11 | 3.00 | 2.91 | 2.64 | .308 | .182 |

*No Lubricant Present

-continued

FORMULA 14-4:

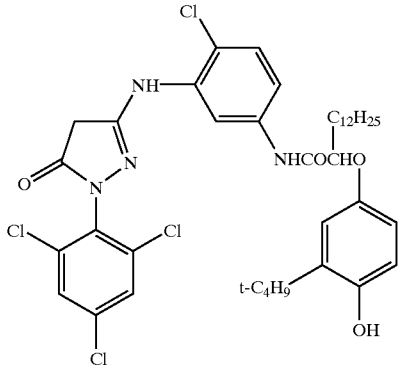

FORMULA 14-5:

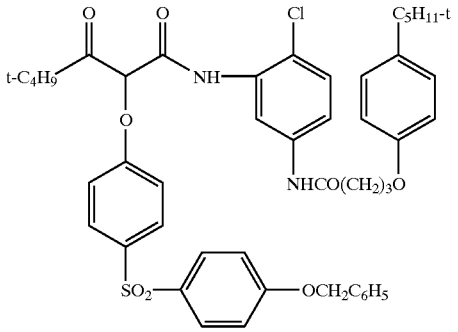

FORMULA 14-13

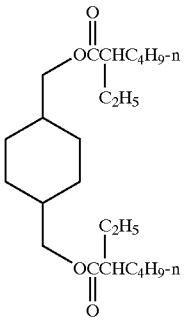

-continued

FORMULA 14-11

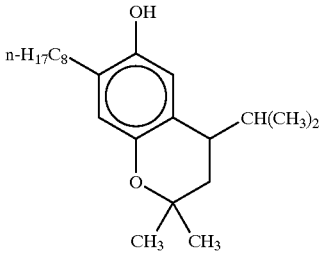

The invention has been described in detail with particular reference to preferred embodiments thereof, but it will be understood that variations and modifications can be effected within the spirit and scope of the invention.

What is claimed is:

1. A photographic element comprising a reflection support, a silver halide emulsion layer, and an overcoat layer wherein said overcoat layer comprises hydrophilic binder and lubricant, said lubricant has a particle mean volume diameter of greater than 1 $\mu$m, is present in an amount between about 0.1 and 100 mg/m$^2$, the volume of particles of lubricant below 1 $\mu$m is less than 5% of said total volume of lubricant and said particles have a mean volume diameter of between about 1 and 12 $\mu$m.

2. The element of claim 1 wherein said lubricant is present in an amount between about 0.5 and 50 mg/m$^2$.

3. The element of claim 1 wherein said particles have a mean volume diameter of between about 1.5 and 7.5 $\mu$m.

4. The element of claim 1 wherein said overcoat layer further comprises filler.

5. The element of claim 4 wherein said filler comprises silica or latex particles.

6. The element of claim 1 wherein said overcoat layer further comprises polymeric gelatin extenders.

7. The element of claim 1 wherein said overcoat layer comprises ultraviolet radiation absorbing polymers.

8. The element of claim 1 wherein said hydrophilic binder comprises acid processed ossein gelatin.

9. The element of claim 1 wherein said lubricant comprises polydimethylsiloxane with viscosity of less than 5000 cS.

10. The element of claim 1 wherein said element comprises a color photographic print material.

11. The element of claim 3 wherein said silver halide emulsion comprises AgCl.

* * * * *